US005463930A

United States Patent [19]

Bisping et al.

[11] Patent Number: 5,463,930

[45] Date of Patent: Nov. 7, 1995

[54] DEVICE FOR FIRING PRACTICE AMMUNITION

[75] Inventors: Bernhard Bisping, Ratingen; Lothar Post, Müden/Fassberg, both of Germany

[73] Assignee: Rheinmetall GmbH, Ratingen, Germany

[21] Appl. No.: 241,861

[30] Foreign Application Priority Data

May 12, 1953 [DE] Germany ..... 4315829.3

[22] Filed: May 12, 1994

[51] Int. Cl.[6] ..... F41A 21/26

[52] U.S. Cl. ..... 89/29; 89/14.3; 89/14.5

[58] Field of Search ..... 42/77, 76.01; 89/14.05, 89/14.3, 14.5, 29

[56] References Cited

U.S. PATENT DOCUMENTS

| | | | |
|---|---|---|---|
| 2,075,837 | 4/1937 | Studler | 89/14.05 |
| 2,902,933 | 9/1959 | Moldofsky et al. | 42/77 |

FOREIGN PATENT DOCUMENTS

| | | | |
|---|---|---|---|
| 579306 | 1/1994 | European Pat. Off. | 42/76.01 |
| 899294 | 5/1945 | France | 89/14.05 |

*Primary Examiner*—Stephen M. Johnson
*Attorney, Agent, or Firm*—Spencer, Frank & Schneider

[57] ABSTRACT

A weapon for firing practice ammunition includes a barrel having a frontal length portion terminating in a muzzle; an ammunition loading chamber at a barrel end opposite the muzzle; and a plurality of first gas outlet bores provided in the frontal length portion. The first gas outlet bores are arranged in a plurality of circumferentially spaced axial rows. There is further provided a muzzle brake sleeve coaxially surrounding the frontal length portion and having a frontal end situated close to the muzzle. The muzzle brake sleeve includes a plurality of second gas outlet bores arranged in a plurality of circumferentially spaced axial rows. The first gas outlet bores are staggered with respect to the second gas outlet bores as viewed along the barrel. The frontal end of the muzzle brake sleeve is closed off by a plug.

13 Claims, 3 Drawing Sheets

1
2
3
4
5
6
7
8
9
10
11
12
13
14
15
16
17
18
19
20
21
22
23
24
24a
25
26
27
28
29
30
34

DEVICE FOR FIRING PRACTICE AMMUNITION

BACKGROUND OF THE INVENTION

This invention relates to a device for firing practice ammunition (projectile-less cartridges). The device includes a weapon barrel or weapon tube which, at its end opposite the muzzle, has a loading chamber and, at its muzzle, has a frontally closed muzzle brake provided with lateral outlet bores. The device may further have a gas-deflecting assembly for the recoil of the barrel caused by the exiting propellant gases.

A device of the above-outlined type for an automatic tube weapon is disclosed, for example, in German Offenlegungsschrift (application published without examination) 37 14 867 which utilizes practice ammunition having no projectiles. In this construction a muzzle brake-like attachment is screwed on the muzzle of the weapon tube. The attachment has an adjustable gas piston for controlling the progression of gas pressure and muzzle sound. The gases exit laterally through bores arranged in a radial plane. In such a construction there are risks of injury by propellant gases and solid particles such as metal, powder or plastic fragments because the braking that can be achieved by the deflection and the pressure decay is insufficient. Residual particles result from stresses on the cartridge tip upon introduction into the loading chamber or upon opening of the cartridge tip under gas pressure. Even if a gas deflecting ring is arranged on the attachment externally thereof to reinforce the recoil of the weapon tube, the above-outlined safety risk persists.

SUMMARY OF THE INVENTION

It is an object of the invention to provide a firing device for practice ammunition of the above-outlined type from which any safety risk in the zone of the muzzle is eliminated.

This object and others to become apparent as the specification progresses, are accomplished by the invention, according to which, briefly stated, the weapon for firing practice ammunition includes a barrel having a frontal length portion terminating in a muzzle; an ammunition loading chamber at a barrel end opposite the muzzle; and a plurality of first gas outlet bores provided in the frontal length portion. The first gas outlet bores are arranged in a plurality of circumferentially spaced axial rows. There is further provided a muzzle brake sleeve coaxially surrounding the frontal length portion and having a frontal end situated close to the muzzle. The muzzle brake sleeve includes a plurality of second gas outlet bores arranged in a plurality of circumferentially spaced axial rows. The first gas outlet bores are staggered with respect to the second gas outlet bores as viewed along the barrel. The frontal end of the muzzle brake sleeve is closed off by a plug.

Thus, according to the invention, the muzzle gas pressure is significantly reduced so that solid residual particles—if they leave the barrel at all—have no longer a critical kinetic energy so that the danger zone around the muzzle is very significantly reduced.

DESCRIPTION OF THE PREFERRED EMBODIMENT

Figure 1:
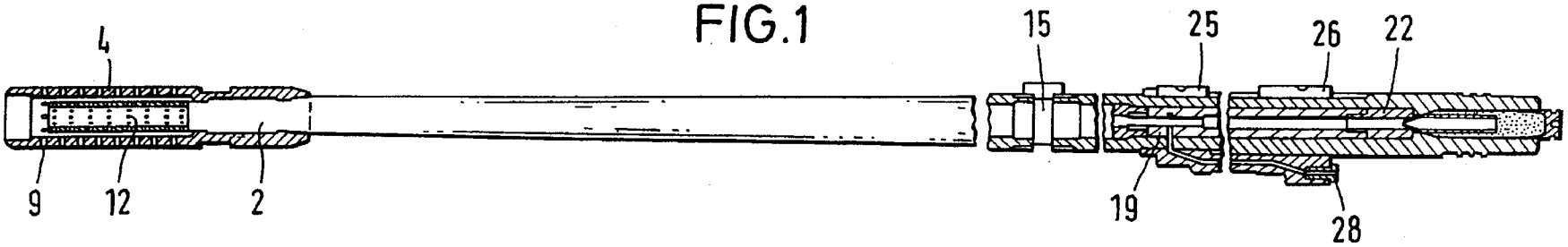
FIG. 1 is an axial sectional view of a preferred embodiment of the invention.
Figure 3:
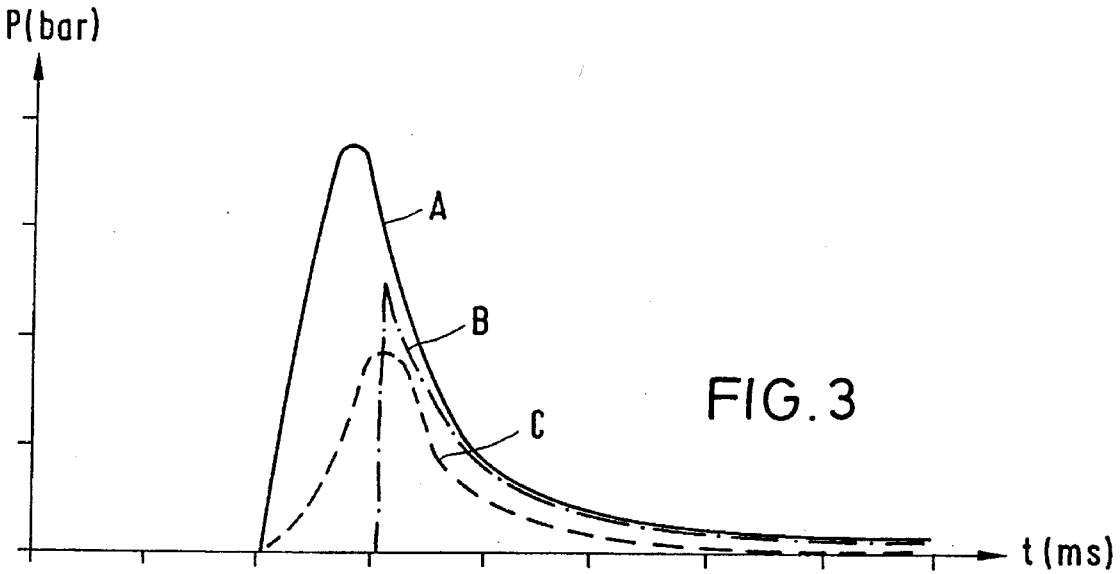
FIG. 3 is a diagram illustrating a gas pressure/time function, wherein curve A represents pressure conditions in the loading chamber of a weapon tube, curve B represents the pressure conditions at the gas outlet of the weapon tube and curve C represents the desired pressure conditions at the gas outlet of the device.
Figures 2A, 2B, 2C:
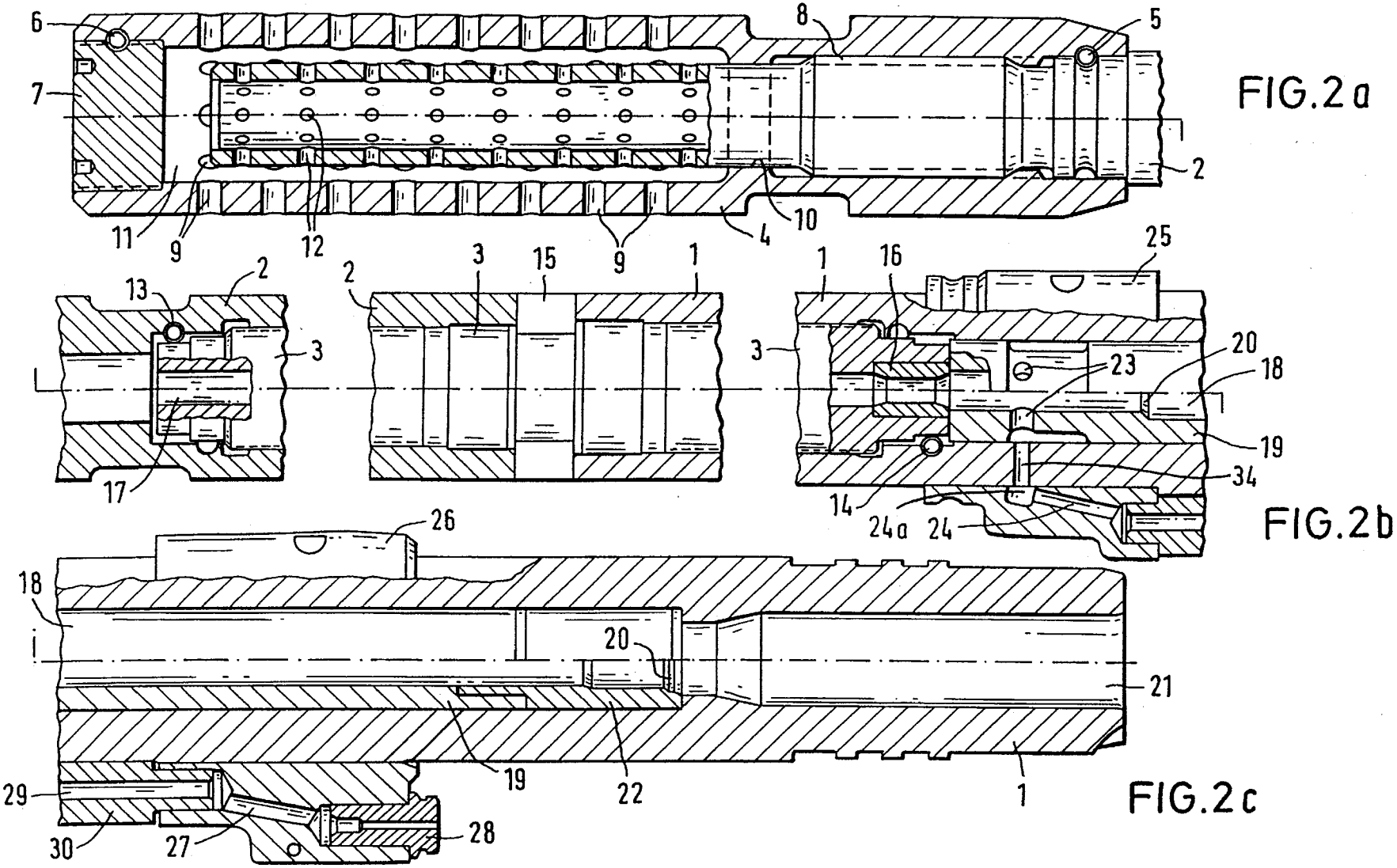
FIGS. 2*a*, 2*b* and 2*c* are enlarged axial sectional views of the preferred embodiment, illustrating consecutive length portions of the device.

Turning to FIGS. 1, 2*a*, 2*b* and 2*c*, the practice ammunition firing device shown therein includes a rear barrel member 1 and a front barrel member 2 which are connected to one another by diametrically different threads of a threaded member 3 and which together constitute a weapon barrel or weapon tube.

The front barrel member 2 has a muzzle on which there is threadedly mounted a muzzle brake (muzzle brake sleeve) 4 which is secured to the front barrel member 2 by a locking pin 5 and is closed by a plug 7 which is held by a locking pin 6 at the muzzle. The muzzle brake 4 is, adjacent its internally threaded portion 8, provided with a plurality of circumferentially distributed axial rows of radial outlet bores 9.

The front barrel member 2 projects into the muzzle brake 4 and terminates close to the plug 7. The circumferential wall face of the front barrel member 2 is at a clearance from the inner circumferential wall face of the muzzle brake 4. The muzzle brake 4 has, in the vicinity of the threaded portion 8, an inner land 10 to define a muzzle brake chamber 11 surrounding the front end portion of the front barrel member 2.

In the zone of the muzzle brake chamber 11 the front end portion of the front barrel member 2 is provided with a plurality of circumferentially distributed axial rows of radial outlet bores 12 which are staggered with respect to the outlet bores 9 of the muzzle brake 4.

The threaded member 3 which is secured by means of locking pins 13 and 14 to the rear and front barrel members 1, 2 has a collar 15 which serves as an abutment for the front end of the rear barrel member 1 and the rear end of the front barrel member 2. The rear terminus of the threaded member 3 is provided with a throttle insert 16 which constricts the axial bores 17 and 18 of the threaded member 3 and that of an insert 19 which is adjoining the threaded member 3 and is disposed in the rear barrel member 1. The insert 19 is rearwardly adjoined by a further insert 22 which has at its rear terminus two run-on chamfers 20 arranged at an axial distance from one another and surrounding the axial bore 18.

The threaded member 3 has a smaller inner cross-sectional area than that of the front barrel member 2. As a result, upon firing of a practice ammunition, there is obtained a substantial, three-step expansion of the propellant gases, first in the long front barrel member 2, then through the outlet bores 12 (provided in the front barrel member 2) and then through the outlet bores 9 (provided in the muzzle brake 4). The outlet bores 9 have diameters which are smaller than those of the bores 12. The total cross-sectional blowout area of the bores 12 is greater than the inner cross-sectional area of the front barrel member 2 in the zone of the bores 2; the ratio of these two areas may be, for example, in a range of 5:1–10:1. By virtue of such arrangement the expansion starts in the front barrel member 2 at a large distance from the plug 7. By virtue of multiple deflections of the propellant gases, the entrained residual particles may be deflected accordingly, so that the latter, if they pass through the outlet bores 9 at all, do not have any critical kinetic energy. Because of the provision of the plug 7, no propellant gases and residual particles leave the weapon barrel through its muzzle.

The rear barrel member 1 has at its rear part a loading chamber 21 which is part of an ammunition supporting chamber that is formed in part directly in the rear barrel member 1 and in part in the insert 22 interengaging the insert 19.

In the insert 19, adjacent the throttle insert 16, a plurality of radial gas take-out bores 23 are provided, which, through radial gas outlet bores 34 provided in the rear barrel member 1, maintain communication between the axial bore 18 and a plurality of generally axially extending channels 24 (only one visible in FIG. **2*b*) provided in a front ring 25 surrounding the rear barrel member 1. The channels 24 merge into an annular chamber 24*a* which is formed in the front ring 25 and which is also in communication with the radial bores 23 of the insert 19. A rear ring 26 is mounted on the rear barrel member 1 at a distance from the front ring 25; the rear ring 26 is provided with two channels 27, each containing an axially extending tubular nozzle 28. The channels 24 and 27 are connected by means of respective channels 29 provided in a connecting member 30 extending between the two rings 25 and 26. The components 23–30** form a propellant gas deflecting device.

Upon firing, the throttle insert 16 causes an accumulation of the propellant gases in front of it, as a result of which a corresponding gas flow through the gas bores 23 takes place so that the weapon recoil, the breech motion and the ammunition advance are ensured in the automatic barrel weapon.

The advantageously replaceable throttle insert 16 which has a fixed (constant) flow passage cross section, is made particularly of heavy tungsten metal which has superior heat and corrosion-resistance properties. By virtue of the proximity of the throttle insert 16 to the gas removal bores 23 and because the inner diameters of the inserts 19 and 22 are significantly less than the caliber of the front barrel member 2, a relatively small gas accumulation space is provided. This makes possible the use of an advantageous propellant which, for example, may be reduced by two-thirds as compared to what is needed for live ammunition. Such propellant is fully combusted at smaller pressures which lead to reduced stresses on the weapon and the propellant cartridge. The reduced value of stress reduction may be, for example, one-fourth of the stresses in case live ammunition is fired. This mode of operation provides for an increased safety for the personnel in case of malfunction caused, for example, by improper handling of the weapon. The throttle insert 16 may be replaced in accordance with the requirements of the weapon function.

The rear insert 22, since it is exchangeably mounted in the rear barrel member 1, may be adapted to the ammunition used. Also, in this manner, a firing of inadvertently loaded live ammunition is prevented.

Figure 4:
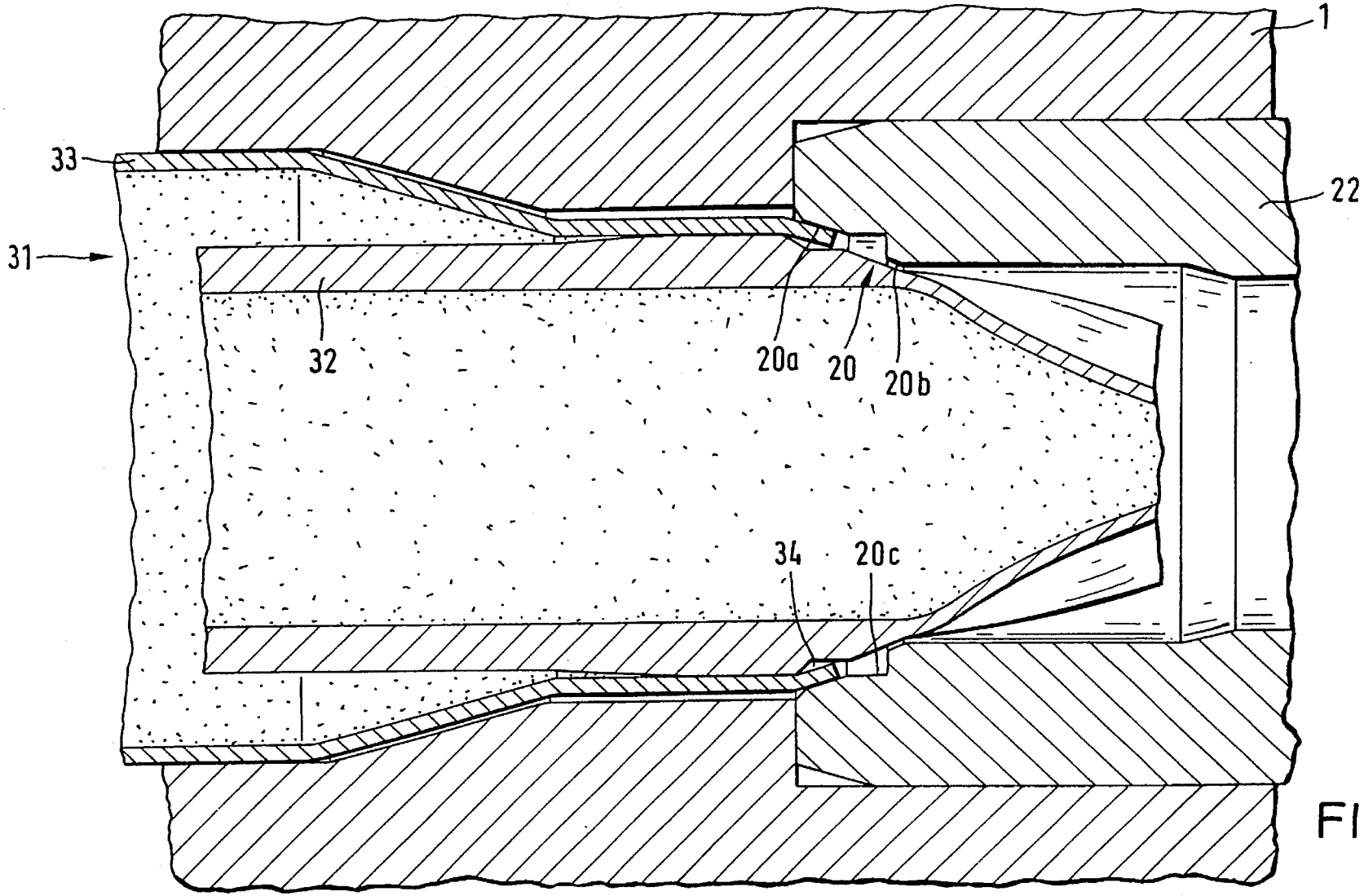
FIG. 4 is an enlarged fragmentary axial view of a portion of the construction shown in FIG. 1.

Also referring to FIG. 4, the rear run-on chamfer 20 of the rear insert 22 is composed of two conically extending annular faces **20*a*, 20*b* which are axially separated from one another by a cylindrical annular face 20*c*. The cone angle of the annular face 20*a* is smaller than that of the annular face 20*b*. Thus, the cone angle of the annular face 20*a* is, for example, in a range of 10°–20°, preferably in a range of 17°–18°. The cone angle of the annular face 20*b*** is, for example, equal to or larger than 25° and is at most, for example, 45°.

Upon loading of the practice ammunition 31, first its bursting body 32 arrives into engagement with the annular face **20*b* so that upon continued advance of the ammunition the bursting body 32 is pushed into its propellant sleeve 33 until the sleeve crimping, opened by the inwardly telescoping bursting body 32, arrives into engagement with the annular face 20*a* and is thereby again crimped firmly about the bursting body 32 in the vicinity of its frontal conical portion which, for this purpose, has a cylindrical zone 34. In this manner, during the subsequent ejection the remaining part of the bursting body 32 is securely removed together with the sleeve 33**.

A coordination of the weapon function regarding the breech recoil, the belt feeder, the weapon recoil, and the cadence height may be achieved by coordinating the following parameters: quantity of propellant, combustion behavior of the propellant, opening resistance of the cartridge in the zone of the cartridge tip (material, strength, wall thickness and manufacturing process), the accumulating volume in front of the throttle insert 16 (length and diameter of the inner bores in the inserts 19, 22), throttle diameter and diameter of the gas removal bores 23.

It will be understood that the above description of the present invention is susceptible to various modifications, changes and adaptations, and the same are intended to be comprehended within the meaning and range of equivalents of the appended claims.

What is claimed is:

1. A weapon for firing practice ammunition, comprising (a) a barrel having (1) a frontal length portion terminating in a muzzle;

(2) means for defining an ammunition loading chamber at a barrel end opposite said muzzle;

(3) a plurality of first gas outlet bores provided in said frontal length portion; said first gas outlet bores being arranged in a plurality of circumferentially spaced axial rows;

(b) a muzzle brake sleeve coaxially surrounding said frontal length portion and having a frontal end situated close to said muzzle; said muzzle brake sleeve including a plurality of second gas outlet bores; said second gas outlet bores being arranged in a plurality of circumferentially spaced axial rows; said first gas outlet bores being staggered with respect to said second gas outlet bores as viewed along said barrel; and (c) plug means for closing off said frontal end of said muzzle brake sleeve.

2. The weapon as defined in claim 1, wherein said barrel comprises a front barrel member, a rear barrel member and a threaded member connecting said rear barrel member with said front barrel member; said front barrel member including said frontal length portion.

3. The weapon as defined in claim 2, wherein said threaded member has an inner cross-sectional area smaller than an inner cross-sectional area of said front barrel member.

4. The weapon as defined in claim 2, wherein said threaded member has a front end and a rear end; said front end of said threaded member being closer to said muzzle than said rear end of said threaded member; further comprising a throttle insert positioned in said rear end of said threaded member.

5. The weapon as defined in claim 4, wherein said throttle insert is of heavy tungsten metal.

6. The weapon as defined in claim 4, further comprising a propellant gas deflecting device mounted on said rear barrel member; said rear barrel member having gas outlet bores communicating with said propellant gas deflecting device; said throttle insert immediately adjoining said gas outlet bores of said rear barrel member.

7. The weapon as defined in claim 4, wherein said throttle insert has a constant flow passage cross section.

8. The weapon as defined in claim 2, further comprising front and rear inserts having axial bores and being disposed in said rear barrel member; said rear insert forming a part of said ammunition loading chamber; said front and rear inserts having an inner diameter less than a caliber diameter of said weapon.

9. The weapon as defined in claim 8, further comprising two axially spaced run-on chamfers provided in said rear insert in a zone of the axial bore of said rear insert.

10. The weapon as defined in claim 8, further comprising a propellant gas deflecting device mounted on said rear barrel member; said rear barrel member having gas outlet bores; wherein said threaded member has a front end and a rear end; said front end of said threaded member being closer to said muzzle than said rear end of said threaded member; further comprising a throttle insert positioned in said rear end of said threaded member; said throttle insert immediately adjoining said gas outlet bores of said rear barrel member; said front insert having gas outlet bores adjacent said throttle insert and being in communication with said gas outlet bores of said rear barrel member; said propellant gas deflecting device having means for defining an annular chamber surrounding said rear barrel member and further having means for defining gas outlet bores being in communication with said annular chamber; said gas outlet bores of said rear barrel member being in communication with said annular chamber.

11. The weapon as defined in claim 2, wherein a total cross-sectional area of said first gas outlet bores is greater than an inner cross-sectional area of said front barrel member in a zone of said first gas outlet bores.

12. The weapon as defined in claim 1, wherein said first gas outlet bores are larger in diameter than said second gas outlet bores.

13. The weapon as defined in claim 1, wherein said means for defining said ammunition loading chamber comprises a run-on chamfer surrounding said ammunition loading chamber; said run-on chamfer including first and second conical annular faces and a cylindrical annular face axially separating said first and second conical annular faces from one another; said first and second conical annular faces widening in a direction opposite said muzzle; said first conical annular face being closer to said muzzle than said second conical annular face; said first conical annular face constituting an abutment for a bursting body of the practice ammunition for pushing the bursting body into a shell sleeve of the practice ammunition upon introduction thereof into said loading chamber; said second conical annular face constituting a crimp maker for crimping the shell sleeve about the bursting body pushed into the shell sleeve upon advance of the practice ammunition in the loading chamber into a firing position.

* * * * *

UNITED STATES PATENT AND TRADEMARK OFFICE

CERTIFICATE OF CORRECTION

PATENT NO. : 5,463,930

DATED : November 7, 1995

INVENTOR(S) : Bernhard Bisping et al

It is certified that error appears in the above-indentified patent and that said Letters Patent is hereby corrected as shown below:

On the title page, item [30] the Foreign Application Priority Data should read --May 12, 1993--.

Signed and Sealed this

Twenty-third Day of January, 1996

*Attest:*

Bruce Lehman

BRUCE LEHMAN

*Attesting Officer*

*Commissioner of Patents and Trademarks*